US006659164B1

(12) United States Patent
Hohenbichler et al.

(10) Patent No.: US 6,659,164 B1
(45) Date of Patent: Dec. 9, 2003

(54) CONTINUOUS CASTING PLANT FOR CONTINUOUS CASTING OF THIN STRIP AND METHOD THEREFOR

(75) Inventors: Gerald Hohenbichler, Kronstorf (AT); Stefano Pellissetti, Linz (IT); Armin Schertler, Guntramsdorf (AT)

(73) Assignees: Acciai Speciali Terni S.p.A. (IT); Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/668,321

(22) Filed: Sep. 22, 2000

Related U.S. Application Data

(63) Continuation of application No. PCT/AT99/00078, filed on Mar. 24, 1999.

(30) Foreign Application Priority Data

Mar. 25, 1998 (AT) ..... 534/98

(51) Int. Cl.[7] ..... B22D 11/12

(52) U.S. Cl. ..... 164/441; 164/428; 164/480; 164/444

(58) Field of Search ..... 164/454, 413, 164/484–441, 480, 428, 486, 444

(56) References Cited

U.S. PATENT DOCUMENTS

| | | | | |
|---|---|---|---|---|
| 4,644,998 A | * | 2/1987 | Mayer | 164/461 |
| 5,350,009 A | | 9/1994 | Mizoguchi et al. | 164/454 |
| 5,484,010 A | * | 1/1996 | Rouzeval et al. | 164/433 |
| 5,816,311 A | * | 10/1998 | Osada et al. | 164/415 |

FOREIGN PATENT DOCUMENTS

| | | |
|---|---|---|
| AT | 402266 | 8/1996 |
| DE | 19542180 | 4/1997 |
| DE | 19637545 | 3/1998 |
| EP | 0726112 | 8/1996 |
| EP | 0540610 | 9/1996 |
| EP | 0780177 | 6/1997 |

OTHER PUBLICATIONS

Patent abstracts of Japan, vol. 018, No. 115 (M–1566), Feb. 24, 1994, & JP 05 309454 A (Nippon Steel Corp; Others: 01), Nov. 22, 1993.

Patent abstracts of Japan, vol. 012, No. 236 (M–715), Jul. 6, 1988 & JP 63 030158 A (Nippon Kokan KK), Feb. 8, 1988.

Patent abstracts of Japan, Continuous Manufacture of Thin Steel Sheet, 56–119607 (A), Sep. 19, 1981, Appln. No. 55–21611, Mitsubishi Jukogyo K.K.

Translation of PCT International Preliminary Examination Report (PCT Article 36 and 70) for International Application No. PCT/AT99/00078, Voest–Alpine Industrieanlagenbau GmbH.

* cited by examiner

*Primary Examiner*—M. Alexandra Elve
*Assistant Examiner*—Len Tran
(74) *Attorney, Agent, or Firm*—Ostrolenk, Faber, Gerb & Soffen, LLP

(57) ABSTRACT

In a continuous casting plant for the continuous casting of a thin strip (14), comprising a mold (8) provided with two casting rolls (6, 7), with a strip-like strand (14) being united from two half-shells (12) and exiting in a vertically downward direction at the nip (13) formed by the casting rolls (6, 7) of said mold, a deflecting-supporting means (16) for deflecting the strand (14) emerging vertically from the mold (8) into a roughly horizontal direction is provided below the nip (13).

In order to gently transfer the strand (14) from the vertical into the horizontal while avoiding great bending stresses or plastic deformations, the deflecting-supporting means (16) of plate-shaped construction has a surface supporting the strand (14) over a large area (FIG. 1).

70 Claims, 4 Drawing Sheets

CONTINUOUS CASTING PLANT FOR CONTINUOUS CASTING OF THIN STRIP AND METHOD THEREFOR

CROSS-REFERENCE TO RELATED APPLICATIONS

This is a continuation application of International Application PCT/AT99/00078, with an International filing date of Mar. 24, 1999.

BACKGROUND OF THE INVENTION

The invention relates to a continuous casting plant for the continuous casting of a thin strip, in particular a steel strip having a thickness of below 20 mm, preferably between 1 and 12 mm, comprising a mold provided with two casting rolls, with a strip-like strand being united from two half-shells and exiting in a vertically downward direction at the nip formed by the casting rolls of said mold, wherein below the nip a deflecting-supporting means is provided for deflecting the strand emerging vertically from the mold into a roughly horizontal direction, and a method for continuous casting.

To keep the structural height and hence the costs low, the strip cast on a continuous casting plant of this kind has to be deflected from the vertical into the horizontal direction of strand discharge as gently as possible. It is also advantageous to support the strip in order to keep down the tensile load acting inside the newly solidified strip at the nip as a result of its own weight.

On the one hand, this gentle deflection must afford protection to the product. This means that excessive bending stress in the outer fiber or excessive plastic deformation in the cooling-down strip must be avoided and that sliding friction along hard, rough surfaces or pointed edges must be avoided in order to eliminate scratching or possible adhering, mainly in the region of the strip edges.

On the other hand, deflection must also involve the least possible damage to the casting process taking place upstream. Usually, a controlling device (e.g. a driver) located downstream provides for the strip extracted from the mold to be carried off without damaging the product. This driver appropriately acts by means of a position control. This means that changes in the casting speed which manifest themselves in a change of the position of the strip (loop formation increases or decreases) must be corrected by the above-mentioned driver (master-slave control principle). These corrective actions of the driver must by no means interfere with the casting operation progressing upstream, e.g. by inducing tensile stress, compressive strain or buckling strain in the hot strip just leaving the nip. Tension control is not suitable in view of the danger of rupturing the still very hot strip (low tensile strength).

To keep down sliding friction and avoid scratching or possible adhering of the strip to the deflecting-supporting means it is known to employ skids for deflection, said skids providing only linear support to the strip, which as a rule has completely solidied upon leaving of the mold, namely linear support in the longitudinal direction of the strip.

A continuous casting plant of the initially described kind is known from JP-A 63-30158. There, the strand exiting the nip of the casting-roll mold in the vertical direction—this narrowing is also referred to as the "kissing point"— is supported on both sides by a support means formed by two support means of conveyor-belt-type construction arranged parallel to each other, e.g. endless chain belts etc., and its movement is constrained over a predetermined vertical region. Subsequent to this constrainment, a guide of arcuate design extending roughly over a quarter circle is provided which serves for deflecting the strand from the vertical direction into a roughly horizontal direction.

According to JP-A 63-30158 it is difficult to ensure that deflection will damage neither the product nor the casting process, especially since the conveyor-belt-like support means arranged directly below the mold as well as subsequently arranged pinch rolls or rolls provided directly on-line exert an influence on the extraction of the strand. A further serious disadvantage is to be seen in that tension control cannot be realized between the mold and the endless chain belts on account of the danger of rupturing the strip, and on account of the danger of buckling of the strip position control cannot be realized, either. Moreover, it is not possible to ensure uniform sliding friction along the arcuate guide deflecting the strand from the vertical into the horizontal. Thus, the strand is exposed to a fluctuation of forces which influences the casting process within the mold in an unforeseeable manner and may cause disturbances during the casting operation.

Further it is known, namely from JP-A 56-119607, to provide a roller table with motor-driven rolls, in imitation of conventional continuous slab casting technology. However, this solution is disadvantageous in that the driven roller table entails high costs, especially since the rolls must not only be driven but must also be provided with internal cooling. Moreover, it is necessary that all of the rolls move synchronously with the casting rolls so as to avoid undesirable relative movements between the rollers and the strip and thus avoid any damage to the strip that might be caused thereby, and this necessitates great expenditures in terms of control engineering, an expensive drive mechanism and strong motors and hence entails additional costs. Furthermore, minor speed differentials may occur even with the most rapid response behavior of the rolls, and it is difficult to maintain the strip in a geometrically precisely defined position in order to actually achieve the optimum supporting effect.

It is further known (EP-B 0 540 610, EP-A 0 726 112 and EP-A 0 780 177) for a loop of strip which is freely suspended during the continuous casting operation to be provided between the pair of casting rolls and the first pair of pinch rolls that conveys the strip onward, resulting in the advantage that at the start of casting the size of the loop of strip will adjust automatically as a function of the casting conditions. Yet, a drawback of this method is the fact that the strand has no supporting device whatsoever; entirely unsupported, the entire weight of the strand is suspended by its hottest and hence weakest strip cross section, which is located at the nip, i.e. the kissing point. This results in a high risk of cracking or rupturing of the strip. In addition, start-up of such a plant is unfavorable, since this can only be done using a dummy bar head. To be able to start up the plant without a dummy bar head it is necessary to have start-up skids, such as those described in EP-A 0 780 177 and EP-A 0 726 112.

From U.S. Pat. No. 5,350,009 it is known in a continuous casting plant according to the preamble of claim 1 to allow the strand to get on a supporting belt moving along with the strand in the extraction direction, which belt is wound with the strand and separated again from the same later on. In order to guide the strand to the supporting belt, it is also known from that document to arrange an arcuate runner below the mold and direct the beginning of the strand toward the supporting belt. As soon as the strand is moved along with the supporting belt, the runner is placed in a resting position remote from the strand. A continuous casting plant of that type is complex in terms of construction and cumbersome to handle, the more so as a supporting belt moving along with the strand has to be provided, which must have at least the length of the continuously cast strand. That belt not only must be moved synchronously along with the strand, but it is also necessary to wind that supporting belt on and off several times in order to separate it from the strand. A continuous casting plant comprising such a supporting belt involves not only high investment costs, but also high operating costs. Furthermore, an arcuate runner is difficult to manufacture, in particular if such a runner is to be provided with a cooling means. In addition, runners of that type do not offer a large area support such that the very thin hot cast strand strip is not offered a good support, which constitutes a problem, in particular in the starting phase, in which the arcuate runners are employed according to that document.

The invention aims at avoiding the above disadvantages and difficulties and providing a continuous casting plant of the initially described kind enabling the strand which exits the mold, i.e. the as cast hot strip, to be deflected from the vertical direction into the horizontal direction while avoiding great bending stresses and avoiding major plastic deformation and while further avoiding great tensile loads.

SUMMARY OF THE INVENTION

According to the invention, this object is achieved in that the deflecting-supporting means is of plate-shaped construction and has a surface supporting the strand over a large area, preferably across its entire width.

In addition to the advantages of solving the problem underlying the invention, a plant of this kind offers the advantage that the leading end of the hot strip can be deflected and conveyed onwards as far as to the first driver, even if casting is initiated without using a cold strip, i.e., if casting is initiated without a starter bar or dummy bar. Further it is possible to cool the cast strip as a function of the quality being cast or also to prevent it from cooling down too much, for which purpose a heat-conducting surface, such as one made from copper or a copper alloy, or a heat-insulating surface, such as one made from ceramics,—as the case may be—is provided on the deflecting-supporting means.

Moreover, only a slight influence on the casting process as a result of this deflection and a careful treatment of the strand are to be ensured according to the invention and, in the case of variations in the casting speed, simple control of strand conveyance is to be feasible without interfering with the casting process in doing so. This is accomplished in that gas transit channels open into the surface of the deflecting-supporting means and are connectable to a gas conveying means.

Numerical calculations have shown that by means of the continuous casting plant of the invention the load on the strand can be alleviated by more than 40% in terms of the tensile stress acting on the strand on the site of the nip as compared to the prior art. The strand is relieved to an even greater extent when comparing a continuous casting plant according to the invention with a plant comprising a freely suspended loop, such as the one described f.i. in EP-B 0 540 610.

A strand supporting means for a horizontal continuous casting plant comprising a melt-receiving vessel provided with a melt outlet past which a casting surface can be moved so as to receive a thin layer of melt thus forming a strand, is known from AT-B 402 266, this known strand supporting means being provided with gas transit channels capable of being connected to a gas conveying means in order to reduce friction between the as yet very thin skin of the strand and the strand supporting means. In this way it is feasible to create a gas cushion between the strand and the strand supporting means such that the strand which still has a very thin skin with melt located thereon is guided on the strand supporting means in almost frictionless manner, thus preventing the occurrence of cracks or scoring etc.

According to a preferred embodiment, thermocouples are provided below the surface of the deflecting-supporting means to serve as sensors for determining the bearing site of the strand on the surface.

Another embodiment is characterized in that, laterally of the deflecting-supporting means, sensors, preferably infrared sensors, are provided for determining the bearing site of the strand on the deflecting-supporting means.

According to the invention, the deflecting-supporting means advantageously is comprised of two or several plate-shaped parts consecutively arranged in the strand extraction direction and is arranged so as to be inclined relative to the horizontal, wherein the inclination of the deflecting-supporting means or at least of a part thereof suitably lies in a range of between 10 and 60°, preferably 15 and 40°, with respect to the horizontal.

Advantageously, the deflecting-supporting means or at least a part thereof is capable of being inclined relative to the horizontal by an adjustment means.

Particularly careful deflection is achieved if the deflecting-supporting means is of concave construction on its side facing the strand, wherein the deflecting-supporting means suitably has a concave and a plane portion.

Another preferred embodiment is characterized in that the deflecting-supporting means is constructed in several parts, the parts being arranged so as to be inclined at different inclinations relative to the horizontal, and wherein suitably at least one individual part of the deflecting-supporting means is capable of being inclined relative to the horizontal by means of an adjustment means individually and independently of other parts of the deflecting-supporting means. Further, it is advantageous that the individual parts of the deflecting-supporting means be hinged to each other.

Advantageously, the gas conveying means is constructed as a means for pressurizing the gas, such as inert gas or air, that is to be conveyed through the gas transit channels. According to another suitable embodiment, the gas conveying means is constructed as a means for imparting a negative pressure on the gas that is to be conveyed through the gas transit channels. This renders it possible to maintain the strand in contact with the deflecting-supporting means during continuous operation, thus ensuring thorough cooling of the strand, especially if in accordance with another preferred embodiment the surface of the deflecting-supporting means or at least of a part thereof is made of a material of high thermal conductivity, in particular copper or a copper alloy. Preferably, this material is provided with a wear-resistant layer such as a Cr or Ni layer of an alloy or a ceramic layer.

Herein, it is suitable for the deflecting-supporting means or at least for a part thereof to be provided with an internal cooling, in particular an internal liquid cooling.

In order to avoid excessive cooling of the strand, the surface of the deflecting-supporting means or at least of a part thereof advantageously is formed of a heat-insulating material, such as ceramics.

In order to keep down gas consumption or get by with only a small-capacity gas conveying means, the gas transit channels at their mouths opening into the surface of the deflecting-supporting means suitably occupy a total cross-sectional area of 0.01 to 20%, preferably 0.1 to 5%, of the strand-supporting surface of the deflecting-supporting means, wherein, advantageously, the gas transit channels at their mouths opening into the surface of the deflecting-supporting means each have a cross-sectional area of 1 to 50 $mm^2$, preferably 5 to 30 $mm^2$.

The generation of a gas cushion, which is beneficial to the casting process, is ensured if the mouths of the gas transit channels are directed such that a gas stream moving substantially in the strand extraction direction is formed.

A method of operating a continuous casting plant according to claim 1 is characterized in that a predetermined pressure is adjusted between the lower surface of the strand and the deflecting-supporting means by appropriate suction and/or feeding of gas via the gas transit channels. In this way, friction between the strip and the surface of the table and hence the supporting effect can be increased in particularly hot-brittle casting operations at greater angles of inclination.

By applying suction and/or supplying a gas to all gas transit channels or only a part thereof, it is feasible to bring the neutral point which is present in the strand and on which neither tensile nor compressive forces occur as the strand is conveyed out of the mold and deflected to the horizontal into a position as close to the mold as possible, i.e. as close to its nip as possible, such that the strand will be least stressed with tensile and/or compressive forces where it is hottest.

BRIEF DESCRIPTION OF THE DRAWINGS

In the following, the invention is explained more fully by means of two exemplary embodiments with reference to the drawings, wherein.

DETAILED DESCRIPTION OF THE PREFERRED EMBODIMENTS

Figure 1:
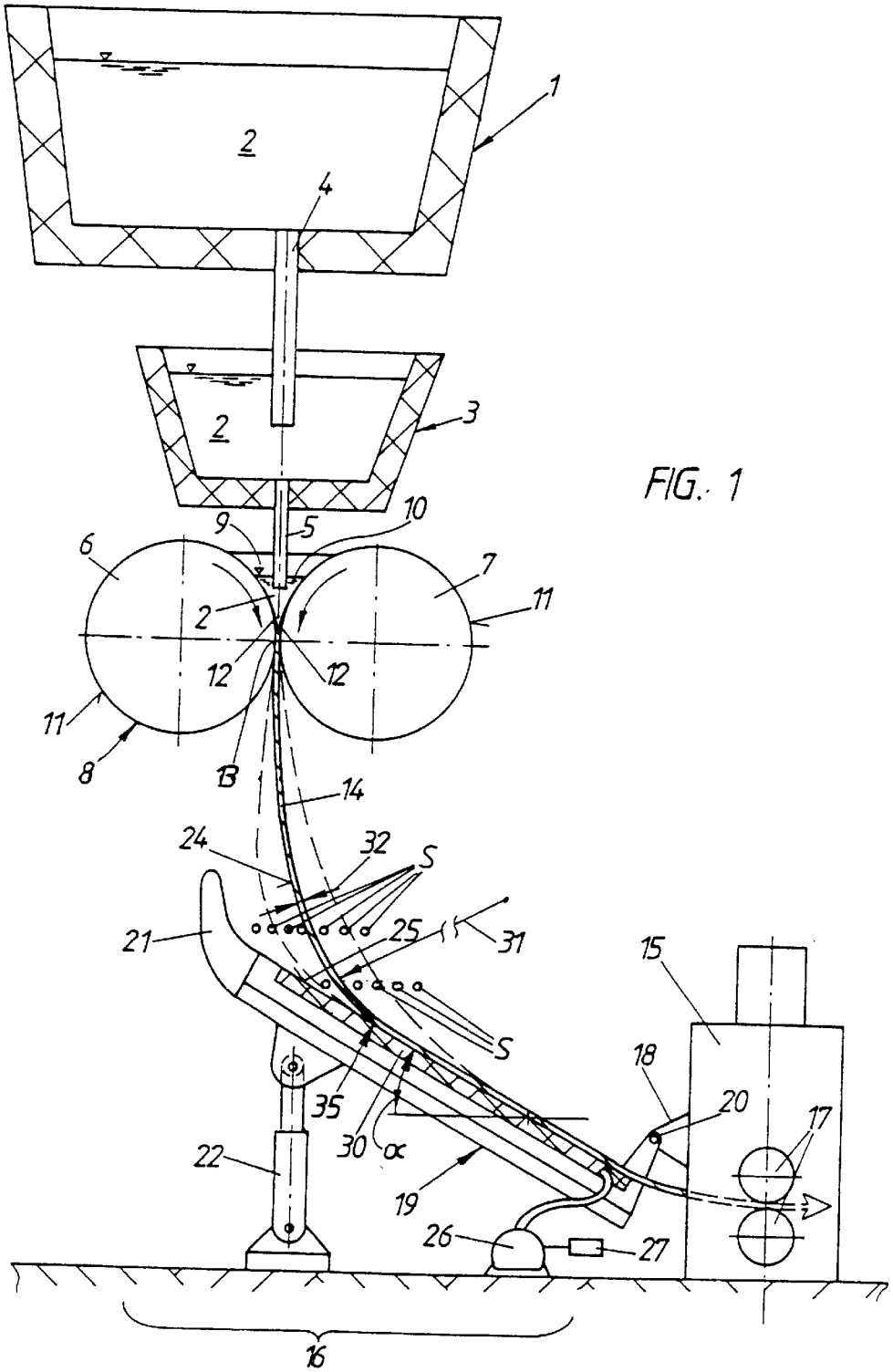
FIGS. 1 and 2 illustrate a continuous casting plant according to one embodiment each, in schematic side view.

There is provided a foundry ladle 1, from which liquid steel 2 flows into a tundish 3 via a bottom opening 4. The tundish 3 comprises a pouring channel 5 inserted on one site of its bottom, which pouring channel projects into a mold 8 provided with two casting rolls 6, 7.

The casting rolls 6, 7 are provided with an internal cooling not illustrated in detail and on their end sides are covered by side plates 9, enabling a liquid sump 10 of steel melt having the pouring channel 5 projecting thereinto to form between the casting rolls 6, 7. The side plates 9 arranged on the end surfaces of the casting rolls 6, 7 glancingly abut on the end surfaces of the casting rolls 6, 7 to prevent the melt 2 from exiting the mold 8.

On the cylindrical surfaces 11 of the casting rolls 6, 7 a respective strand shell 12 is each formed which progressively thickens over the circumference of the respective one of the casting rolls 6, 7. At the nip 13 (also referred to as kissing point) existing between the casting rolls 6, 7, the strand shells 12 are pressed against each other, such that a strip-like strand 14 is formed. At the nip 13, i.e. at the kissing point, this strand 14 has a temperature of between 1200 and 1400° C., depending on the respective steel quality.

Vertically below the nip 13, a deflecting-supporting means 16 is provided which deflects to the horizontal the strand 14 exiting the mold 8, with the strand 14 being fed to a pair of pinch rolls 17 after sliding downward via the deflecting-supporting means 16 and, after passing through this pair of pinch rolls 17, being guided onwards along a horizontal guide not illustrated in detail in conventional fashion, e.g. being fed to a rolling means or coiling means provided on-line. A strand separating means is also provided after the pair of pinch rolls 17.

According to the illustrated exemplary embodiment, the deflecting-supporting means 16 is constructed in one piece and plate-shaped in the supporting region and has a suspension 18 which is arranged on the pinch roll strand 15 and to which a plate 19 is hinged by means of a joint 20. This plate 19 on its free end has a concave end portion 21 curved toward the approaching strand 14, with the free end of the deflecting-supporting means 16 extending beyond the nip 13 such that the strand 14 exiting the mold 8 is sure to impinge on the deflecting-supporting means 16. The deflecting-supporting means 16 is arranged so as to be inclined relative to the horizontal and can be inclined relative to the horizontal within a certain range, advantageously in a range of between 10 and 60°, in particular in a range of between 15 and 40°, by an adjusting means 22 constructed e.g., as a pressure-medium cylinder. Possible positions of the strand above the deflecting-supporting means 16 have been shown in FIGS. 1 and 2 in broken lines.

The deflecting-supporting means 16 extends in the width direction of the strand 14 over the entire width thereof, enabling a large area of the strand to rest on the deflecting-supporting means 16. Alternatively, it could be slightly narrower than the strand 14, in which case the borders of the strand 14 would project freely.

On its surface 25, the deflecting-supporting means 16 is provided with gas transit channels 23 connectable to at least one gas conveying means 26. Thus, a gas such as an inert gas or air can be selectively blown between the lower surface 24 of the strand 14 and the surface 25 of the deflecting-supporting means 16 through the gas transit channels 23. By creating a negative pressure by sucking off gas (air) through the gas transit channels 23, a thorough contact can be created between the lower surface 24 of the strand and the surface 25 of the deflecting-supporting means 16, thus affording not only a good cooling effect of the deflecting-supporting means 16, which is advantageously provided with an internal cooling 29, the upper layer 30 of the deflecting-supporting means being in this case formed of a metal of high thermal conductivity, such as copper or a copper alloy, but also enabling a certain extent of friction to be achieved that opposes the strand-withdrawal movement.

The gas conveying means 26 can suitably be activated or deactivated via a control means 27 with a view to both creating an overpressure and providing a negative pressure. By adjusting a predetermined friction between the lower surface 24 of the strand 1 and the surface 25 of the deflecting-supporting means 16, the supporting effect of the deflecting element can be further increased, especially at more pronounced angles of inclination $\alpha$ of the deflecting-supporting element 16. More pronounced angles of inclination $\alpha$ afford a shorter freely-suspended length of the strand (and hence a smaller mass of the strand) by positioning the bearing site 35 higher above. Yet, as a result of the more pronounced angle of inclination $\alpha$ of the surface 25, the supporting effect afforded to the strand 14 will decrease at a lower friction (increased throughput of gas) along the surface 25. By increasing the friction (at a lower throughput of gas down to a negative gas pressure), the supporting effect can be successfully increased. By adjusting a particular friction in combination with a particular angle of inclination α, optimum support can be afforded to the strand 14 in a simple manner and thus the tensile stress acting on the strand 14 in the region of the nip 13 can be minimized.

If the casting speed changes, it is sought to keep the curve of strip travel or strand travel constant through appropriate readjustment of the peripheral speed of the pinch rolls 17.

An essential feature of the deflecting-supporting means 16, i.e., its configuration is that the radius 31 of strand curvature which adjusts at the deflection site must never fall short of the value of 100 times the strip thickness 32, and in the case of especially sensitive qualities must never fall short of the value of 200 times the strip thickness 32.

Figure 2:
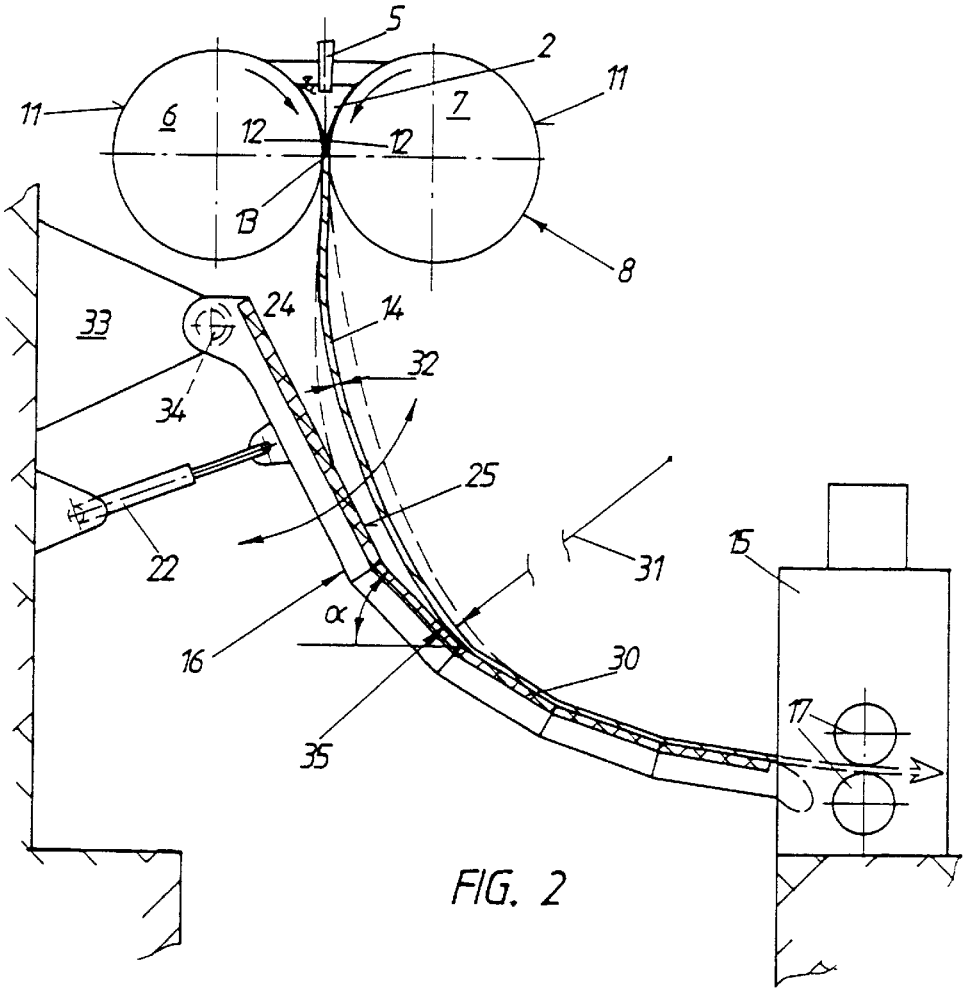

According to the embodiment shown in FIG. 2, the deflecting-supporting means 16 for manufacturing reasons is configured as a draft of traverse, i.e., comprised of several plate-shaped elements consecutively arranged in the extraction direction of the strand. In this case, the deflecting-supporting means 16 is mounted not on the pinch roll stand 15 but on a stationary support structure 33 by its upper end by means of a pivoting joint 34. Here, too, a pressure medium cylinder 22 or any other adjusting means, such as an adjustment spindle etc., serves to adjust the inclination of the deflecting-supporting means 16. This embodiment has the advantage that the deflecting-supporting means 16 when casting steel grades that are less prone to cracking need be in the position shown in FIG. 2 only at the start of the casting operation—if casting is initiated without the use of a cold strip—in order to guide the leading edge of the strip to the pair of pinch rolls 17. When the casting process has become stable, the deflecting-supporting means 16 may then be pivoted away; however, when casting steel grades which are prone to rupturing, it remains in the position shown in FIG. 2 even during the casting process. Once again, Me gas transit channels 23 are likewise provided in the upper layer 30 to create an overpressure or a negative pressure between the strand 14 and the surface 25 of the deflecting-supporting means 16.

Figure 4:
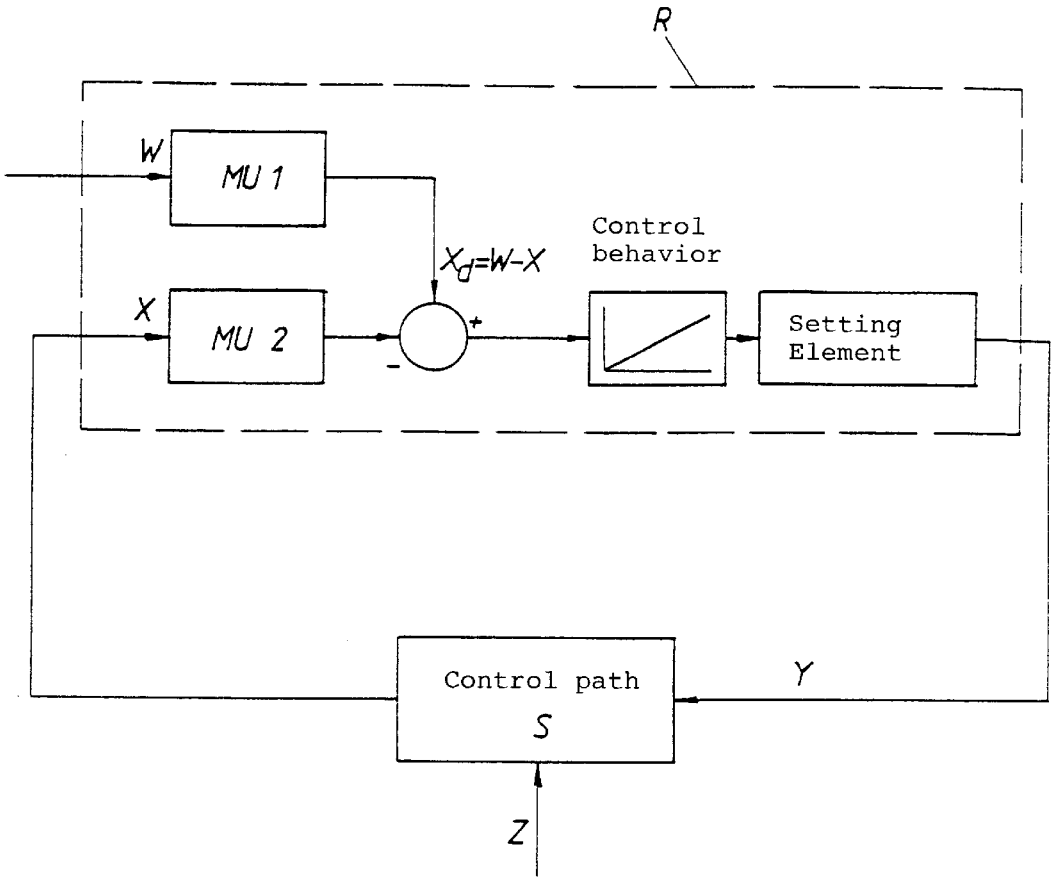
FIG. 4 schematically illustrates a method of controlling the position of the strand below the mold by means of a diagram.

FIG. 4 shows a control circuit for controlling the speed of the pair of pinch rolls 17. Due to changes in the speed of the casting process, that is, due to changes in the rotational frequency of the casting rolls 6 and 7, which are operational, it is necessary to control the rotational frequencies of the pinch rolls 17 in order to achieve a roughly constant position of the strand below the mold 8 and hence a uniform load, i.e. tensile forces which act uniformly on the strand, and in order to avoid the danger both of a rupture and of buckling of the strand. Changes in the speed of the casting process, i.e. changes in the rotational frequencies of the casting rolls 6 and 7, act as the disturbance variable Z. The correcting variable Y is the expulsion speed of the pinch rolls 17. The position of the strand 14, e.g. the bearing site 35 of the strand 14 on the deflecting-supporting means 16, detected by a sensor S, is employed as the controlled variable and measurable variable X. The command variable W is a predetermined set value for the position of the strand 14, wherein the term set value of the position of the strand 14 means that the strand assumes an ideal curvature at which the radius 31 of this curvature of the strand 14 does not fall short of a predetermined minimum value and at which it is also ensured that the strand will not experience too much tensile stress nor will undergo too much buckling stress. The difference of the actual value from the set value, i.e. W minus X, constitutes the deviation $X_d$. MU 1 and MU 2 denote transducers, with MU 1 emitting a measuring signal for the set value of the position of the strand 14 and MU 2 measuring signal corresponding to the position of the strand 14 as detected by the sensor S. The region of FIG. 4 that is surrounded by broken line represents the automatic controller R.

This circuit allows the neutral point, where the strand 14 exhibits neither compressive nor tensile stresses, to be moved close to the nip 13 and be maintained there such that the strand 14 will be free from strain as much as possible during the entire casting process or exposed to the slightest possible forces where it is jeopardized most, i.e. where it is hottest, namely at its very exit from the mold 8.

According to FIG. 1, sensors S for detecting the position of the strand 14 are provided laterally of the deflecting-supporting means 16 in order to detect the bearing site 35 of the strand 14 on the deflecting-supporting means 16. In accordance with FIG. 1, these sensors S are designed e.g. as infrared sensors. The actual position of the strand 14 can be detected by means of these sensors S.

Figure 3:
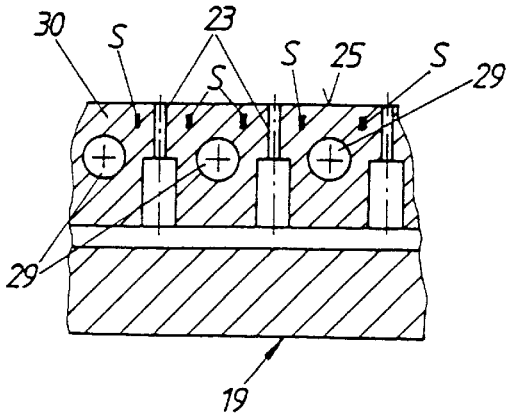
FIG. 3 shows a detail of FIGS. 1 and 2 in section.

Alternatively, the bearing site 35, at which the strand 14 touches the surface 25 of the deflecting-supporting means 16 for the first time, can be detected by means of sensors S integrated below the surface 25, as is illustrated f.i. in FIG. 3. There, the sensors S are designed as thermocouples.

The invention is not limited to the exemplary embodiment illustrated in the drawing but may be modified in various respects; e.g., the entire deflecting-supporting means 16 may be stationarily arranged on the continuous casting plant. The principal purpose of adjusting the inclination of the deflecting-supporting means 16 is to ensure the respective optimum curve of strip travel for particularly hot-brittle steel grades.

The deflecting-supporting means 16 also may be constructed in several parts, comprising more than two parts, but with at least one part, namely the part arranged first in the direction of casting, being changeable in inclination. In this case, the individual parts of the deflecting-supporting means 16 suitably are hinged to each other.

Furthermore, it is conceivable for little hot-brittle and less delicate steel grades to be cast on the continuous casting plant, to transfer, for instance fold away, the deflecting-supporting means 16 configured according to FIG. 1, into a resting position remote from the strand after a starting phase, e.g., after having reached stationary operating conditions.

Figure 5:
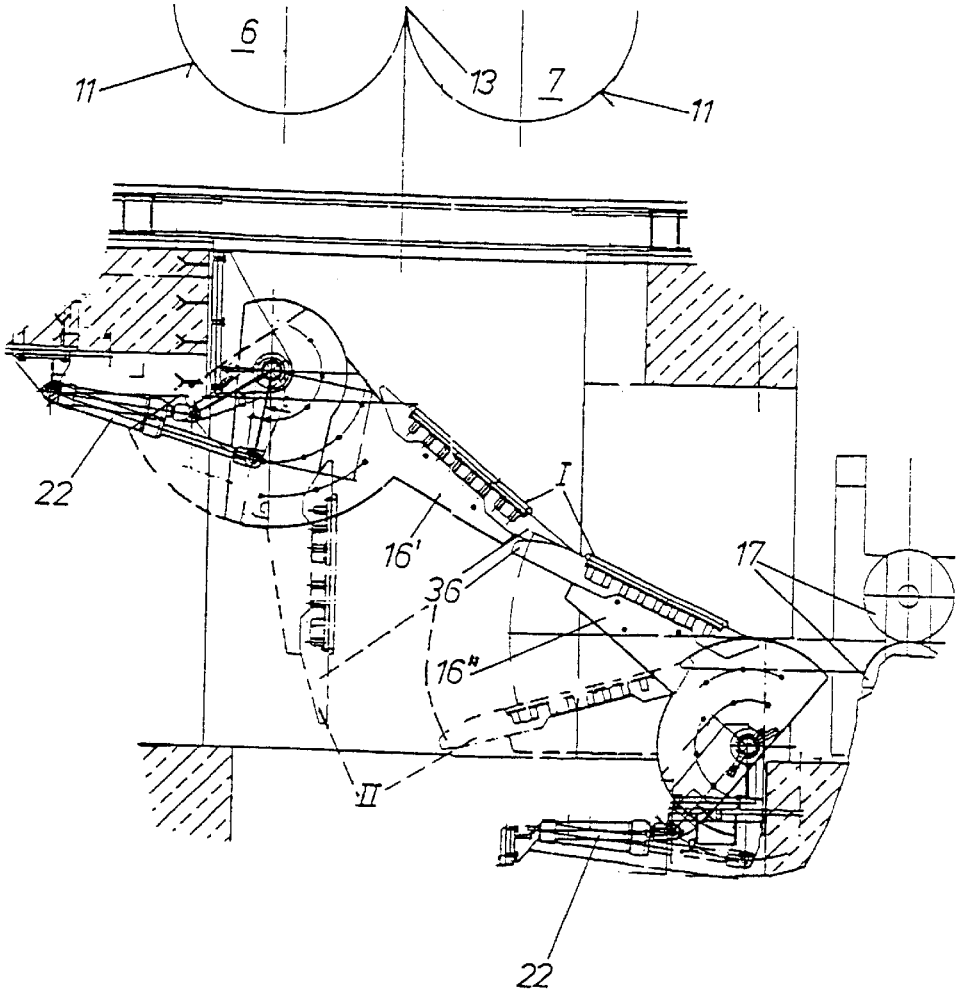
FIG. 5 represents a further embodiment of a continuous casting plant according to the invention.

According to FIG. 5, the deflecting-supporting means 16 is comprised of two plate-shaped parts 16', 16" each pivotably mounted on the base, wherein one part 16', which is arranged directly below the nip site 13, is hinged on the base on a level higher than the other part 16". Both parts 16'and 16" are pivotable by means of pressure medium cylinders 22 likewise mounted on the base, i.e., from the position I drawn in full lines, in which the two parts 16', 16" complement each other to form a continuous surface, into the position II shown in full lines, and back. The oppositely directed end regions 36 of the two pivotable plate-shaped parts 16', 16" mesh like a toothing such that a continuous sliding surface without steps is formed as the two parts 16', 16" have been pivoted into the position I illustrated in FIG. 5 in full lines.

What is claimed is:

1. A continuous casting plant for the continuous casting of a thin strip having a thickness of below 20 mm, consisting of a mold provided with two casting rolls, with a strip-like strand being united from two half-shells and exiting in a vertically downward direction at the nip formed by the casting rolls of said mold, wherein below the nip a deflecting-supporting means is provided for deflecting the strand emerging vertically from the mold into a roughly horizontal direction, wherein the deflecting-supporting means, as a first guide element of the strip, is provided below the casting rolls, and the deflecting-supporting means has a plate-shaped construction and has a surface supporting the strand over a large area, at least a portion of the surface of the deflecting-supporting means being made of a material of high thermal conductivity.

2. A continuous casting plant according to claim 1, wherein gas transit channels open into the surface of the deflecting-supporting means and are connectable to a gas conveying means.

3. A continuous casting plant according to claim 1, wherein below the surface of the deflecting-supporting means thermocouples are provided as sensors for determining the bearing site of the strand on the surface.

4. A continuous casting plant according to claim 1, wherein, laterally of the deflecting-supporting means, sensors are provided for determining the bearing site of the strand on the deflecting-supporting means.

5. A continuous casting plant according to claim 1, wherein the deflecting-supporting means is comprised of two or several plate-shaped parts consecutively arranged in the strand extraction direction.

6. A continuous casting plant according to claim 1, wherein the deflecting-supporting means is arranged so as to be inclined relative to the horizontal.

7. A continuous casting plant according to claim 6, wherein the inclination of the deflecting-supporting means lies in a range of between 10° and 60° with respect to the horizontal.

8. A continuous casting plant according to claim 1, wherein at least a part of the deflecting-supporting means is capable of being inclined relative to the horizontal by an adjustment means.

9. A continuous casting plant according to claim 1, wherein the deflecting-supporting means is of concave construction on its side facing the strand.

10. A continuous casting plant according to claim 1, wherein the deflecting-supporting means has a concave and a plane portion.

11. A continuous casting plant according to claim 1, wherein the deflecting-supporting means is constructed in several parts, with individual parts being arranged so as to be inclined at different inclinations relative to the horizontal.

12. A continuous casting plant according to claim 11, wherein at least one of the individual parts of the deflecting-supporting means is capable of being inclined relative to the horizontal by means of an adjustment means individually and independently of other parts of the deflecting-supporting means.

13. A continuous casting plant according to claim 11, wherein the individual parts of the deflecting-supporting means are hinged to each other.

14. A continuous casting plant according to claim 2, wherein the gas conveying means is constructed as a means for pressurizing the gas.

15. A continuous casting plant according to claim 2, wherein the gas conveying means is constructed as a means for imparting a negative pressure on the gas that is to be conveyed through the gas transit channels.

16. A continuous casting plant according to claim 1, wherein at least a part of the surface of the deflecting-supporting means is formed of a heat-insulating material.

17. A continuous casting plant according to claim 2, wherein the gas transit channels at their mouths opening into the surface of the deflecting-supporting means occupy a total cross-sectional area of 0.01 to 20% of the strand-supporting surface of the deflecting-supporting means.

18. A continuous casting plant according to claim 2, wherein the gas transit channels at their mouths opening into the surface of the deflecting-supporting means each have a cross-sectional area of 1 to 50 $mm^2$.

19. A continuous casting plant according to claim 2, wherein the mouths of the gas transit channels are directed such that a gas stream moving substantially in the strand extraction direction is formed.

20. A continuous casting plant according to claim 1, wherein the entire deflecting-supporting means is displaceable from a resting position remote from the strand path into a position supporting the strand, and back.

21. A method of operating a continuous casting plant according to claim 2, wherein a predetermined pressure is adjusted between the lower surface of the strand of the deflecting-supporting means by appropriate suction and/or feeding of gas via the gas transit channels.

22. A continuous casting method according to claim 21, wherein the neutral point present in the strand, where neither tensile nor compressive forces incur while the strand is being conveyed out of the mold and deflected into the horizontal, is adjusted to a position as close as possible to the nip by adjusting a speed of withdrawal by means of a subsequently arranged pair of pinch rolls.

23. A continuous casting method according to claim 22, wherein by selecting a speed of withdrawal by means of the subsequently arranged pair of pinch rolls the radius of the strip curvature at the deflection site is adjusted such that said radius does not fall short of the value of 100 times the thickness of the strand.

24. A continuous casting plant according to claim 1, wherein the deflecting-supporting means has a surface supporting the strand over its entire width.

25. A continuous casting plant according to claim 4, wherein said sensors are infrared sensors.

26. A continuous casting plant according to claim 7, wherein said inclination is in a range of between 15° and 40° with respect to the horizontal.

27. A continuous casting plant according to claim 14, wherein said gas is an inert gas or air.

28. A continuous casting plant according to claim 16, wherein the surface of the deflecting-supporting means is formed of a ceramic material.

29. A continuous casting method according to claim 23, wherein said radius does not fall short of the value of 200 times the thickness.

30. A continuous casting plant according to claim 1, wherein said deflecting-supporting means has a surface supporting the strand across its entire width.

31. A continuous casting plant according to claim 1, wherein said material of high thermal conductivity is copper or a copper alloy.

32. A continuous casting plant according to claim 31, wherein said surface of copper or copper alloy is provided with a wear-resistant layer.

33. A continuous casting plant according to claim 1, wherein said thin strip is a steel strip.

34. A continuous casting plant for the continuous casting of a thin strip having a thickness of below 20 mm, consisting of a mold provided with two casting rolls, with a strip-like strand being united from two half-shells and exiting in a vertically downward direction at the nip formed by the casting rolls of said mold, wherein, below the nip a deflecting-supporting means is provided for deflecting the strand emerging vertically from the mold into a roughly horizontal direction, wherein the deflecting-supporting means, as a first guide element of the strip, is provided below the casting rolls, and the deflecting-supporting means has of plate-shaped construction and has a surface supporting the strand over a large area, at least a portion of the deflecting-supporting means being provided with internal cooling.

35. A continuous casting plant according to claim 34, wherein said deflecting-supporting means has a surface supporting the strand across its entire width.

36. A continuous casting plant according to claim 34, wherein said internal cooling is liquid cooling.

37. A continuous casting plant according to claim 34, wherein said thin strip is a steel strip.

38. A continuous casting plant according to claim 34, wherein gas transit channels open into the surface of the deflecting-supporting means and are connectable to a gas conveying means.

39. A continuous casting plant according to claim 34, wherein below the surface of the deflecting-supporting means thermocouples, are provided as sensors for determining the bearing site of the strand on the surface.

40. A continuous casting plant according to claim 34, wherein, laterally of the deflecting-supporting means, sensors are provided for determining the bearing site of the strand on the deflecting-supporting means.

41. A continuous casting plant according to claim 34, wherein the deflecting-supporting means is comprised of two or several plate-shaped parts consecutively arranged in the strand extraction direction.

42. A continuous casting plant according to claim 34, wherein the deflecting-supporting means is arranged so as to be inclined relative to the horizontal.

43. A continuous casting plant according to claim 42, wherein the inclination of the deflecting-supporting means lies in a range of between 10° and 60° with respect to the horizontal.

44. A continuous casting plant according to claim 34, wherein at least a part of the deflecting-supporting means is capable of being inclined relative to the horizontal by an adjustment means.

45. A continuous casting plant according to claim 34, wherein the deflecting-supporting means is of concave construction on its side facing the strand.

46. A continuous casting plant according to claim 34, wherein the deflecting-supporting means has a concave and a plane portion.

47. A continuous casting plant according to claim 34, wherein the deflecting-supporting means is constructed in several parts, with individual parts being arranged so as to be inclined at different inclinations relative to the horizontal.

48. A continuous casting plant according to claim 47, wherein at least one of the individual parts of the deflecting-supporting means is capable of being inclined relative to the horizontal by means of an adjustment means individually and independently of other parts of the deflecting-supporting means.

49. A continuous casting plant according to claim 47, wherein the individual parts of the deflecting-supporting means are hinged to each other.

50. A continuous casting plant according to claim 38, wherein the gas conveying means is constructed as a means for pressurizing the gas.

51. A continuous casting plant according to claim 38, wherein the gas conveying means is constructed as a means for imparting a negative pressure on the gas that is to be conveyed through the gas transit channels.

52. A continuous casting plant according to claim 34, wherein at least a part of the surface of the deflecting-supporting means is formed of a heat-insulating material.

53. A continuous casting plant according to claim 38, wherein the gas transit channels at their mouths opening into the surface of the deflecting-supporting means occupy a total cross-sectional area of 0.01 to 20% of the strand-supporting surface of the deflecting-supporting means.

54. A continuous casting plant according to claim 38, wherein the gas transit channels at their mouths opening into the surface of the deflecting-supporting means each have a cross-sectional area of 1 to 50 $mm^2$.

55. A continuous casting plant according to claim 38, wherein the mouths of the gas transit channels are directed such that a gas stream moving substantially in the strand extraction direction is formed.

56. A continuous casting plant according to claim 34, wherein the entire deflecting-supporting means is displaceable from a resting position remote from the strand path into a position supporting the strand, and back.

57. A method of operating a continuous casting plant according to claim 38, wherein a predetermined pressure is adjusted between the lower surface of the strand of the deflecting-supporting means by appropriate suction and/or feeding of gas via the gas transit channels.

58. A continuous casting method according to claim 57, wherein the neutral point present in the strand, where neither tensile nor compressive forces incur while the strand is being conveyed out of the mold and deflected into the horizontal, is adjusted to a position as close as possible to the nip by adjusting a speed of withdrawal by means of a subsequently arranged pair of pinch rolls.

59. A continuous casting method according to claim 58, wherein by selecting a speed of withdrawal by means of the subsequently arrange pair of pinch rolls the radius of the strip curvature at the deflection site is adjusted such that said radius does not fall short of the value of 100 times the thickness of the strand.

60. A continuous casting plant according to claim 34, wherein the deflecting-supporting means has a surface supporting the strand over its entire width.

61. A continuous casting plant according to claim 40, wherein said sensors are infrared sensors.

62. A continuous casting plant according to claim 43, wherein said inclination is in a range of between 15° and 40° with respect to the horizontal.

63. A continuous casting plant according to claim 50, wherein said gas is an inert gas or air.

64. A continuous casting plant according to claim 34, wherein at least a portion of the deflecting-supporting means is provided with internal land cooling.

65. A continuous casting plant according to claim 52, wherein the surface of the deflecting-supporting means is formed of a ceramic material.

66. A continuous casting method according to claim 59, wherein said radius does not fall short of the value of 200 times the thickness.

67. A continuous casting plant according to claim 34, wherein said deflecting-supporting means has a surface supporting the strand across its entire width.

68. A continuous casting plant according to claim 34, wherein said internal cooling is liquid cooling.

69. A continuous casting plant for the continuous casting of a thin strip having a thickness of below 20 mm, consisting of a mold provided with two casting rolls, with a strip-like strand being united from two half-shells and exiting in a vertically downward direction at the nip formed by the casting rolls of said mold, wherein below the nip a deflecting-supporting means is provided for deflecting the strand emerging vertically from the mold into a roughly horizontal direction, wherein the deflecting-supporting means, as a first guide element of the strip, is provided below the casting rolls, and the deflecting-supporting means has a plate-shaped construction and has a surface supporting the strand over a large area, at least a portion of the surface of the deflecting-supporting means being made of a material of high thermal conductivity and is provided with internal liquid cooling.

70. A continuous casting plant according to claim 69, wherein said thin strip is a steel strip.

* * * * *